US009913012B2

(12) United States Patent
Williams et al.

(10) Patent No.: US 9,913,012 B2
(45) Date of Patent: Mar. 6, 2018

(54) ACOUSTIC DEVICE WITH CURVED PASSIVE RADIATORS

(71) Applicant: Bose Corporation, Framingham, MA (US)

(72) Inventors: Chester Smith Williams, Lexington, MA (US); Brandon Westley, Hopkinton, MA (US); Roman N. Litovsky, Newton, MA (US)

(73) Assignee: Bose Corporation, Framingham, MA (US)

( * ) Notice: Subject to any disclaimer, the term of this patent is extended or adjusted under 35 U.S.C. 154(b) by 155 days.

(21) Appl. No.: 14/484,794

(22) Filed: Sep. 12, 2014

(65) Prior Publication Data

US 2016/0080845 A1 Mar. 17, 2016

(51) Int. Cl.

| | |
|---|---|
| ***H04R 1/02*** | (2006.01) |
| ***H04R 1/28*** | (2006.01) |
| ***H04R 5/02*** | (2006.01) |

(52) U.S. Cl.

CPC ..... *H04R 1/02* (2013.01); *H04R 1/28* (2013.01); *H04R 5/02* (2013.01); *H04R 2400/03* (2013.01); *H04R 2400/11* (2013.01)

(58) Field of Classification Search

CPC . H04R 5/02; H04R 1/025; H04R 1/02; H04R 1/2834; H04R 31/00; H04R 1/283; H04R 1/28; H04R 2400/03; H04R 2400/11

See application file for complete search history.

(56) References Cited

U.S. PATENT DOCUMENTS

| | | | | |
|---|---|---|---|---|
| 3,780,824 | A * | 12/1973 | Prince | H04R 1/2834 181/144 |
| 7,133,533 | B2 * | 11/2006 | Chick | H04R 1/2834 381/160 |
| 7,676,054 | B2 | 3/2010 | Setiabudi et al. | |
| 7,931,505 | B2 | 4/2011 | Howard et al. | |
| 8,369,558 | B2 | 2/2013 | Conrad et al. | |
| D692,411 | S | 10/2013 | Joseph | |
| 2007/0058830 | A1 * | 3/2007 | Setiabudi | H04R 5/02 381/349 |
| 2009/0130884 | A1 * | 5/2009 | Howard | B60R 11/02 439/297 |

(Continued)

OTHER PUBLICATIONS

SpeeCup Product Information Guide, Apr. 2014, <http://www.icreation.com/download/DL/speeCup-Product-Information-Guide.pdf>.

*Primary Examiner* — Fan Tsang
*Assistant Examiner* — Angelica M McKinney
(74) *Attorney, Agent, or Firm* — Bose Corporation

(57) ABSTRACT

An acoustic device includes an acoustic assembly that defines a first acoustic volume. The acoustic assembly includes at least one passive radiator in acoustic communication with the first acoustic volume. A first electro-acoustic driver is configured to acoustically energize the first acoustic volume so as to drive the piston in oscillatory motion. The acoustic device also includes a housing within which the acoustic assembly is disposed. The housing has a curved inner surface. The passive radiator has a curvature which conforms to the curvature of the curved inner surface of the housing so as to reduce unused space between the at least one passive radiator and the curved inner surface of the housing.

23 Claims, 10 Drawing Sheets

(56) References Cited

U.S. PATENT DOCUMENTS

| | | | | |
|---|---|---|---|---|
| 2012/0250875 | A1* | 10/2012 | Nicholson | H03G 3/348 381/77 |
| 2012/0250924 | A1* | 10/2012 | Nicholson | H04R 1/02 381/334 |
| 2013/0010970 | A1* | 1/2013 | Hegarty | H04S 5/00 381/18 |
| 2013/0170684 | A1* | 7/2013 | Nicholson | H03G 3/348 381/334 |
| 2013/0213628 | A1* | 8/2013 | Litovsky | H04R 1/2834 165/185 |
| 2014/0355806 | A1* | 12/2014 | Graff | H04R 1/025 381/334 |
| 2015/0139464 | A1* | 5/2015 | Guo | H04R 1/02 381/334 |
| 2015/0334481 | A1* | 11/2015 | Amae | H04R 1/02 381/386 |

* cited by examiner

ACOUSTIC DEVICE WITH CURVED PASSIVE RADIATORS

BACKGROUND

This disclosure relates to an acoustic device with curved passive radiators.

U.S. patent application Ser. No. 13/076,547 discloses a portable loudspeaker that includes an electro-acoustic driver which creates sound waves when operated and a housing having a front side to which the driver is secured. An internal part of the housing defines a first portion of an acoustic volume in which at least a portion of the driver is located. A passive radiator is secured to the housing and is located on the same side of the housing as the driver. The sound waves from the driver are capable of energizing the acoustic volume which causes the passive radiator to vibrate and emit sound waves.

SUMMARY

This disclosure is based, in part, on the realization that an acoustic device (e.g., a portable loudspeaker) having a curved housing can be provided with one or more passive radiators that have a curvature which conforms to that of the housing, thereby to increase the packaging efficiency of the acoustic device. All examples and features mentioned below can be combined in any technically possible way.

In one aspect, an acoustic device includes an acoustic assembly that defines a first acoustic volume. The acoustic assembly includes at least one passive radiator in acoustic communication with the first acoustic volume. The at least one passive radiator includes a piston. A first electro-acoustic driver is configured to acoustically energize the first acoustic volume so as to drive the piston in oscillatory motion. The acoustic device also includes a housing within which the acoustic assembly is disposed. The housing has a curved inner surface. The passive radiator has a curvature which conforms to the curvature of the curved inner surface of the housing so as to reduce unused space between the at least one passive radiator and the curved inner surface of the housing.

Implementations may include one of the following features, or any combination thereof.

In some implementations, the at least one passive radiator also includes a piston, a frame that surrounds the piston, and a suspension that connects the piston to the frame such that the piston is displaceable, relative to the frame, along a motion axis. The frame has the curvature which conforms to the curvature of the curved inner surface of the housing.

In certain implementations, the piston has the curvature which conforms to the curvature of the curved inner surface of the housing.

In some cases, the at least one passive radiator includes a plurality of passive radiators arranged in a radial array about a central axis of the acoustic device.

In certain cases, the curved inner surface of the housing circumferentially surrounds the central axis of the acoustic device.

In some examples, each of the plurality of passive radiators faces a respective segment of the curved inner surface of the housing, and each of the passive radiators has a curvature which conforms to the curvature of the respective segment of the curved inner surface of the housing.

In certain examples, the first electro-acoustic driver is configured to acoustically energize the first acoustic volume so as to drive the plurality of passive radiators in oscillatory motion along respective motion axes.

In some implementations, the acoustic device also includes one or more electronic components (e.g., a battery) disposed within the first acoustic volume in a region between the plurality of passive radiators.

In certain implementations, a motion axis of the first electro-acoustic driver is coincident with a central axis of the acoustic device.

In some cases, the acoustic device also includes a cover for enclosing the acoustic assembly within the housing. The cover includes buttons for controlling operation of the acoustic device.

In certain cases, the curved surface of the housing is frustoconical.

In some examples, the housing is cup-shaped.

In certain examples, the acoustic device includes a first acoustic sub-assembly and a second acoustic sub-assembly. The first acoustic sub-assembly defines the first acoustic chamber and includes the first electro-acoustic driver, and the at least one passive radiator. The second sub-assembly defines a second acoustic volume and a third acoustic volume. The second sub-assembly includes a second electro-acoustic driver, and a third electro-acoustic driver. A portion of the second electro-acoustic driver is located in the second acoustic volume and a portion of the third electro-acoustic driver is located in the third acoustic enclosure.

In some implementations, the second and third electro-acoustic drivers are arranged with their respective motion axes at an elevation angle of about 15 degrees to about 45 degrees from horizontal so as to direct acoustic energy in an upward direction during normal operation.

In certain implementations, the second and third electro-acoustic drivers are arranged with an azimuth angle of about 30 degrees to about 60 degrees between their respective motion axes.

In some cases, the second sub-assembly is mounted to the first sub-assembly so as to form a slot through which acoustic energy from the first electro-acoustic driver can be radiated.

In certain cases, the housing has an opening aligned with the slot to allow acoustic energy from the first electro-acoustic driver to be radiated to a listening area acoustically isolated from the first acoustic volume.

In some examples, the acoustic device is a portable loudspeaker.

In certain examples, the portable loudspeaker is configured to communicate wirelessly with a source of audio content.

In some implementations, the acoustic device is configured to fit within a standard automobile cup holder.

In certain implementations, the housing has a curved outer surface which conforms to the curvature of the curved inner surface of the housing.

DETAILED DESCRIPTION

Figure 1A:
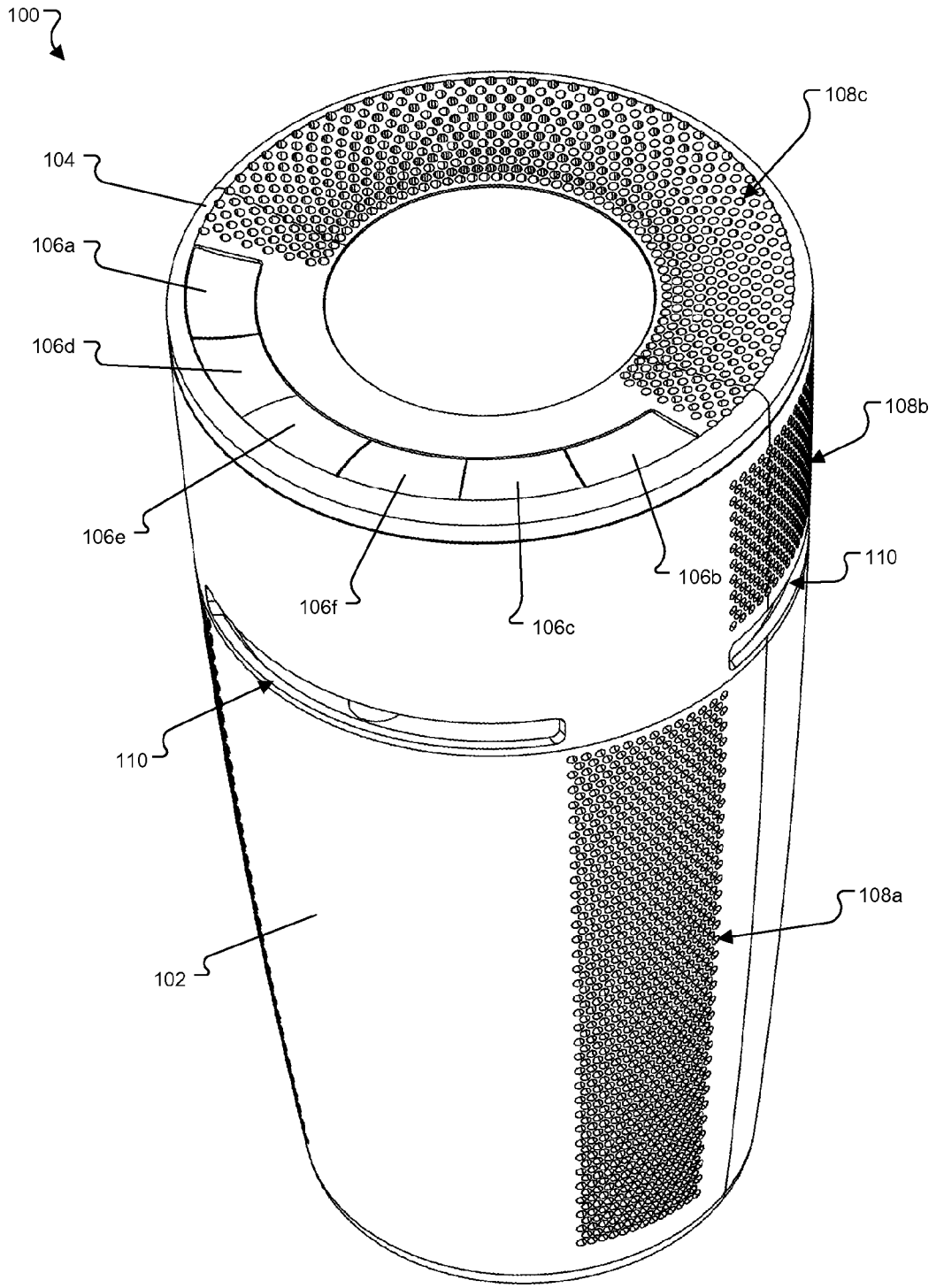
FIG. 1A is a perspective view of a portable loudspeaker as seen from the top and rear side.
Figure 1B:
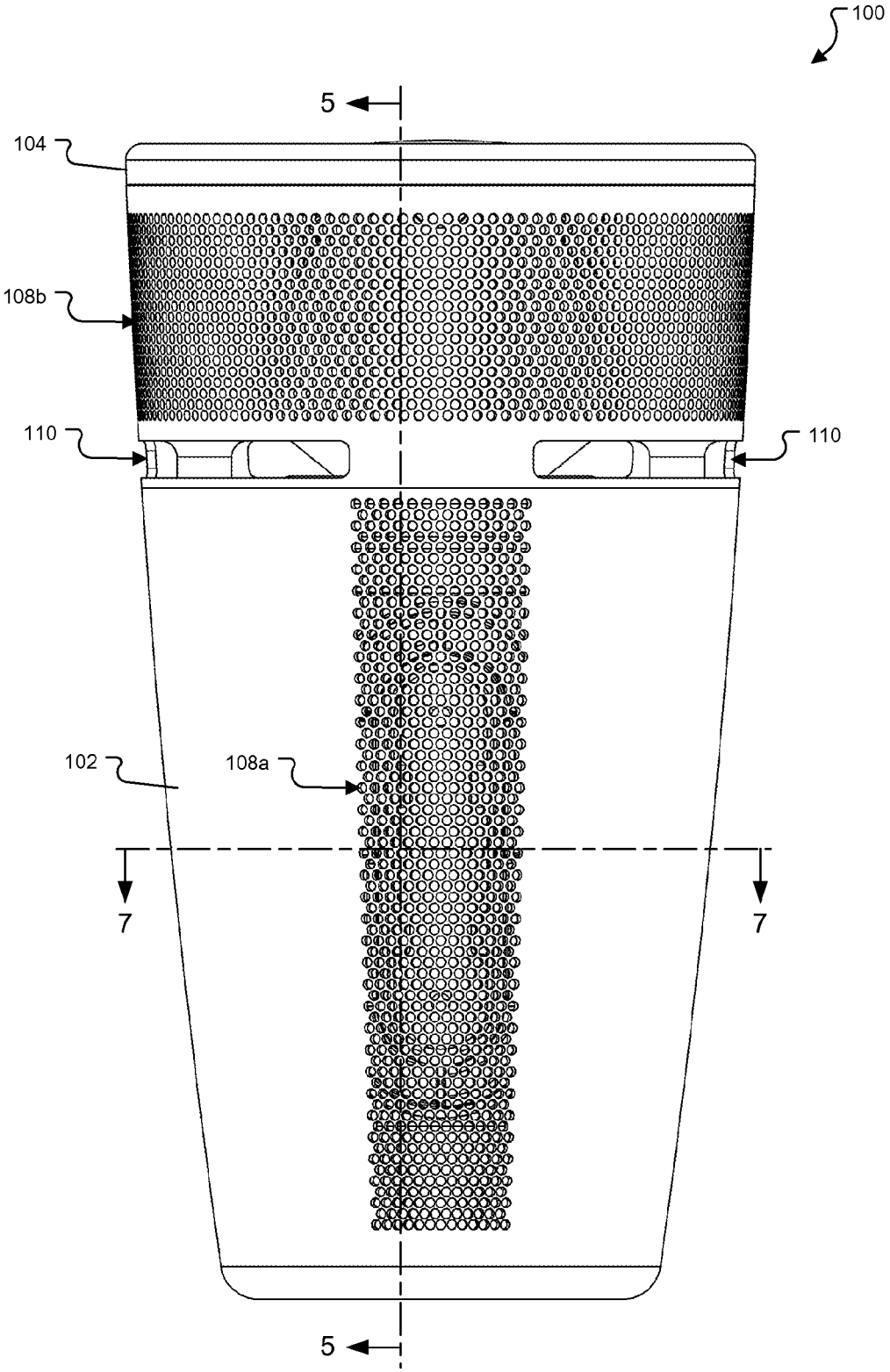
FIG. 1B is a front elevation view of the portable loudspeaker of FIG. 1A.

With reference to FIGS. 1A and 1B, an acoustic device (illustrated in the form of a portable loudspeaker 100) includes a housing 102 and a cover 104. A series of buttons 106*a-f* along a top surface of the cover 104 can be used to control operation of the loudspeaker 100. Referring to FIG. 1A, a "Power" button 106*a* is pressed to turn the loudspeaker 100 on or off. An "Aux" button 106*b* is pressed to select an auxiliary audio source (not shown) which can provide an audio signal to the loudspeaker 100 via a hard-wired electrical connection. A "Bluetooth" button 106*c* is pressed to select a Bluetooth® audio source (not shown) which can provide an audio signal to the loudspeaker 100 via a wireless connection. A "Mute" button 106*d* can be pressed to mute or un-mute the loudspeaker 100. A "Vol−" button 106*e* is pressed to decrease the volume of the loudspeaker 100. A "Vol+" button 106*f* is pressed to increase the volume of the loudspeaker 100.

The loudspeaker 100 includes grille regions 108*a-c* in the housing 102 and the cover 104. The grille regions 180*a-c* are substantially acoustically transparent to allow for passage of acoustic energy from a region within the housing 102 to a listening area external to the housing 102. The listening area may be, for example, a passenger cabin of a vehicle. The housing 102 also includes slot openings 110 to permit the passage of acoustic energy from a region within the housing 102 to a listening area external to the housing 102.

In the illustrated example, the portable loudspeaker 100 is configured to fit within a standard automobile cup holder. A standard automobile cup holder is 2.5 to 3 inches in diameter, with the average size being 2.56 inches. To achieve this configuration, the loudspeaker 100 is provided with a size and a shape of a standard drinking cup (e.g., a standard 12 oz., 16 oz., or 22 oz. drinking cup). The dimensions of these standard cup sizes are provided in Table 1 below.

TABLE 1

| Cup Size | Bottom Diameter | Top Diameter | Height |
|---|---|---|---|
| 12 oz. | 2.0 in. (52 mm) | 3.2 in. (81 mm) | 4.3 in. (110 mm) |
| 16 oz. | 2.4 in. (61 mm) | 3.5 in. (89 mm) | 4.9 in. (124 mm) |
| 22 oz. | 2.4 in. (61 mm) | 3.5 in. (89 mm) | 5.9 in. (149.2 mm) |

In this regard, the portable loudspeaker 100 may have a substantially cylindrical (e.g., frustoconical) shape with a bottom diameter of about 2.0 inches to about 2.4 inches, and a height of about 4.3 inches to about 5.9 inches. The benefits of a portable loudspeaker that is sized to fit within a vehicle cup holder are that it is removable from the vehicle, and, thus, can be beneficial for preventing theft; and it can be easily integrated in any vehicle.

Figure 2:
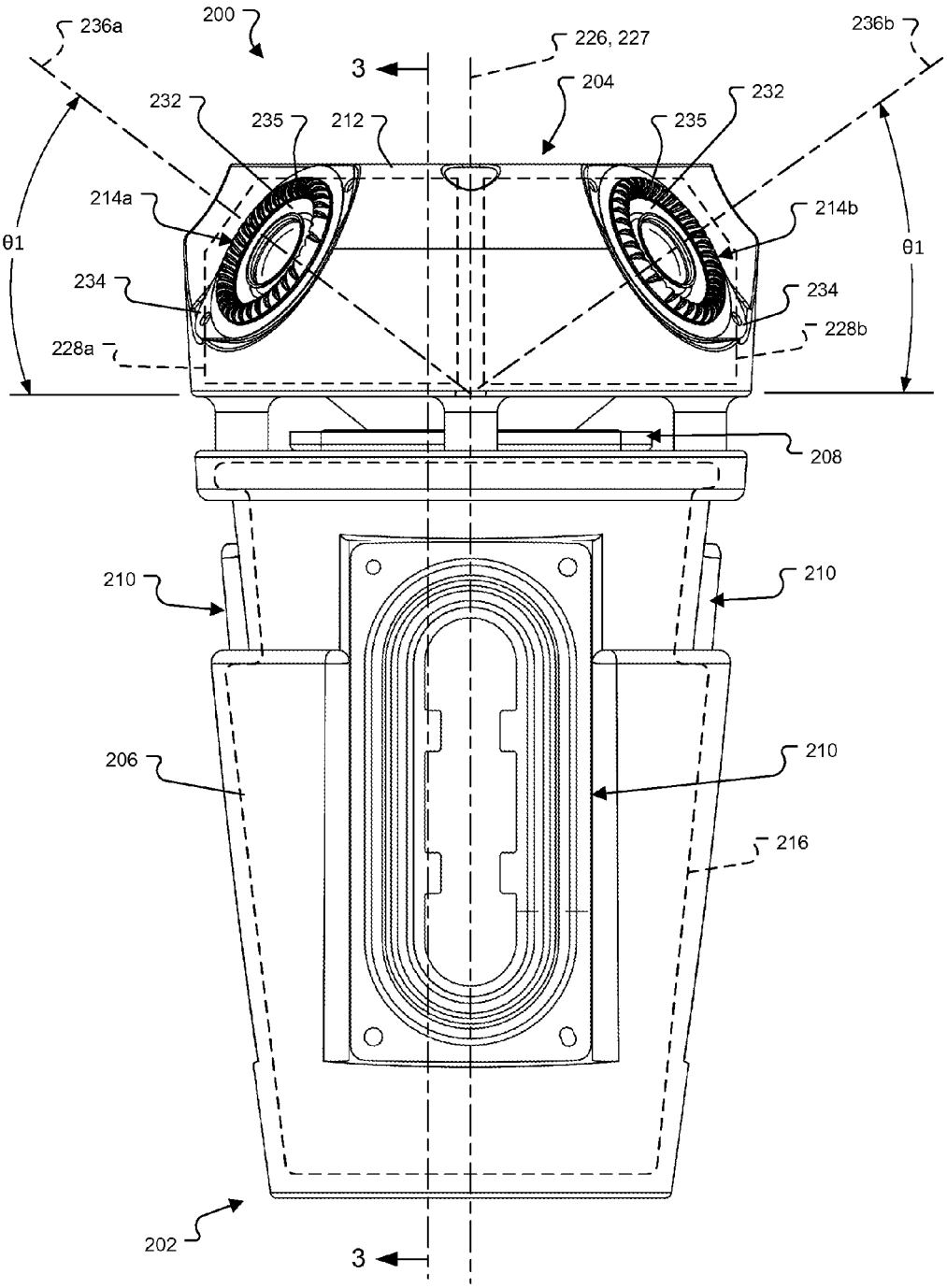
FIG. 2 is a front elevation view of an acoustic assembly from the portable loudspeaker of FIG. 1A.
Figure 3:
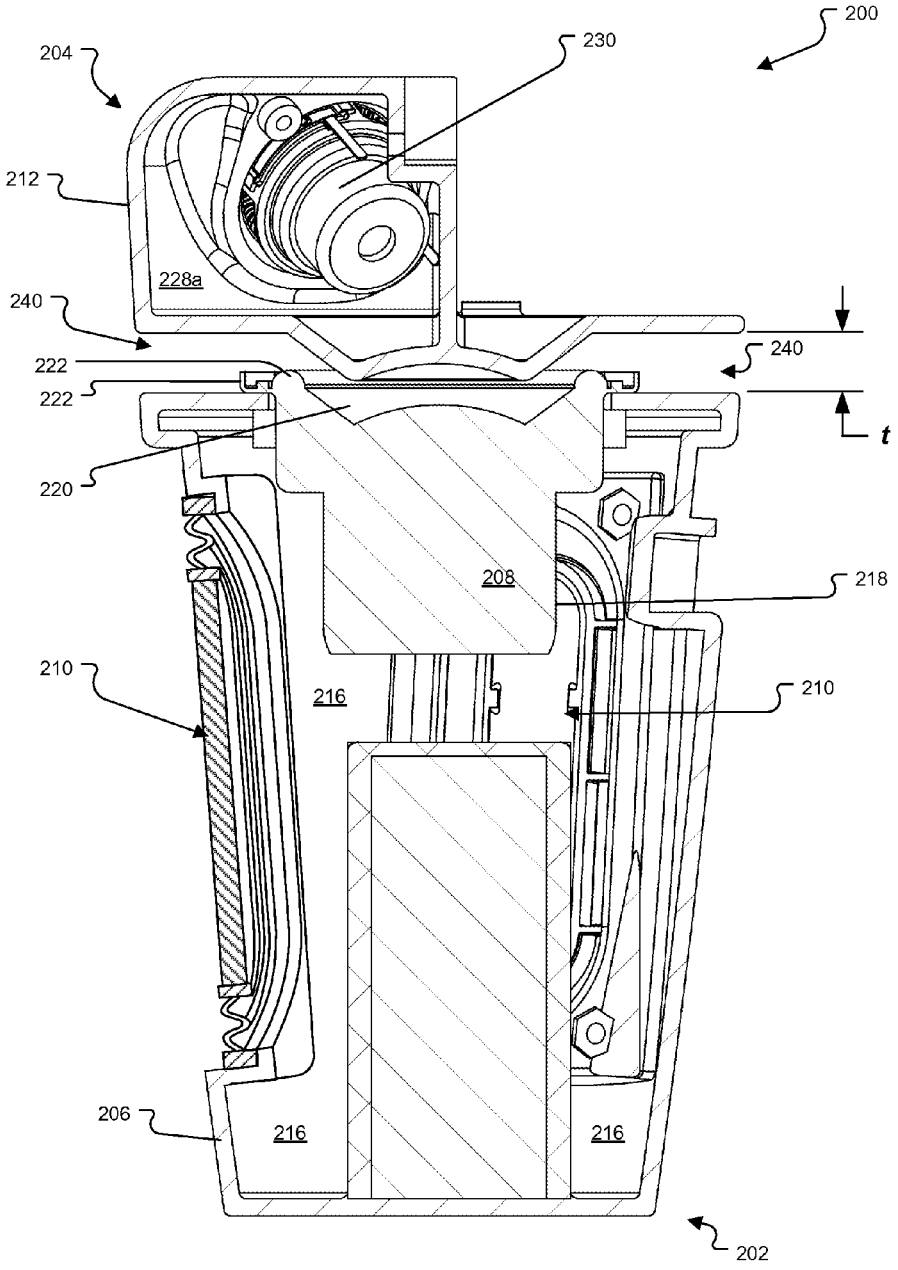
FIG. 3 is a cross-sectional view taken along line 3-3 in FIG. 2.

Referring to FIGS. 2 and 3, the cover 104 and housing 102 enclose an acoustic assembly 200. The acoustic assembly 200 includes a first, full-range acoustic sub-assembly 202 and a second, high frequency sub-assembly 204. The first acoustic sub assembly 202 includes a first acoustic enclosure 206, a first electro-acoustic driver 208, and a plurality of passive radiators 210 for providing enhanced bass performance. The second acoustic sub-assembly 204 includes a second acoustic enclosure 212 and a pair of high frequency drivers (i.e., second and third electro-acoustic drivers 214*a*, 214*b*).

The first acoustic enclosure 206, the first electro-acoustic driver 208, and the plurality of passive radiators 210 together define a first (substantially air tight) acoustic volume 216. The first electro-acoustic driver 208 is secured to the first acoustic enclosure 206 and generates acoustic energy when operated. At least a portion of the first electro-acoustic driver 208 is located within the first acoustic volume 216. Acoustic energy from the first electro-acoustic driver 208 is capable of acoustically energizing the first acoustic volume 216 which, in turn, drives the passive radiators 210 in linear, oscillatory motion causing the passive radiators 210 to emit acoustic energy.

The first electro-acoustic driver 208 includes a drive unit 218 (e.g., a voice coil motor), a diaphragm 220, a frame 222 for supporting the drive unit 218 and the diaphragm 220, and a surround 224 connecting the diaphragm 220 to the frame 222. The frame 222 mounts straight to the first acoustic enclosure 206 with screws (not shown).

The drive unit 218 and a rear surface of the diaphragm 220 are located within the first acoustic volume 216. The drive unit 218 drives the diaphragm 220 in linear motion along a motion axis 226 (FIG. 2). In the illustrated example, the first electro-acoustic driver 208 is arranged such that its motion axis 226 is coincident with a vertical axis 227 (a/k/a vertical centerline a/k/a central axis) of the portable loudspeaker 100. The first electro-acoustic driver 208 is a full-range driver for reproducing frequencies in the 300 Hz to 5000 Hz range.

The second acoustic enclosure 212 and the second and third electro-acoustic drivers 214*a*, 214*b* together define a second acoustic volume 228*a* and a third acoustic volume 228*b*. The third electro-acoustic driver 214*b* and the third acoustic volume 228*b* are not shown in FIG. 3, however, it should be understood that those features are the mirror image of the second electro-acoustic driver 214*a* and the second acoustic volume 228*a* which are shown in FIG. 3.

The second and third electro-acoustic drivers 214*a*, 214*b* are secured to the second acoustic enclosure 212 and generate acoustic energy when operated. At least a portion of each of the second and third drivers 214*a*, 214*b* is located in a respective one of the second and third acoustic volumes 228*a*, 228*b*. That is, at least a portion of the second acoustic driver 214*a* is located in the second acoustic volume 228*a*, and at least a portion of the third acoustic driver 214*b* is located in the third acoustic volume 228*b*. Acoustic energy from the second and third electro-acoustic drivers 214*a*, 214*b* is capable of acoustically energizing the second and third acoustic volumes 228*a*, 228*b*, respectively.

Each of the second and third electro-acoustic drivers 214*a*, 214*b* includes a drive unit 230 (e.g., a voice coil motor), a diaphragm 232, a speaker frame 234 for supporting the drive unit 230 and the diaphragm 232, and a surround 235 connecting the diaphragm 232 to the speaker frame 234. The speaker frames 234 mount straight to the second acoustic enclosure 212 with screws (not shown).

The drive unit 230 and a rear surface of the diaphragm 232 of the second electro-acoustic driver 214*a* are located within the second acoustic volume 228*a*. The drive unit 230 and a rear surface of the diaphragm 232 of the third electro-acoustic driver 214*b* are located within the third acoustic volume 228*b* (FIG. 2). The drive units 230 drive the diaphragms 232 in linear motion along respective motion axes 236*a*, 236*b*.

The second and third electro-acoustic drivers 214 are arranged such that their respective motion axes 236*a*, 236*b* are each arranged at an elevation angle θ1 of about 10 degrees to about 30 degrees (e.g., 15 degrees) relative to horizontal. Reference to horizontal is made with respect to the orientation of the portable loudspeaker 100 during normal intended use. This results in the second and third drivers 214*a*, 214*b* pointing slightly upward such that acoustic energy radiated from the front surfaces of the diaphragms 232 is directed upward—in the general direction of a vehicle occupants ears when the portable loudspeaker 100 is positioned in a cup holder in the passenger compartment of a vehicle.

Figure 4:
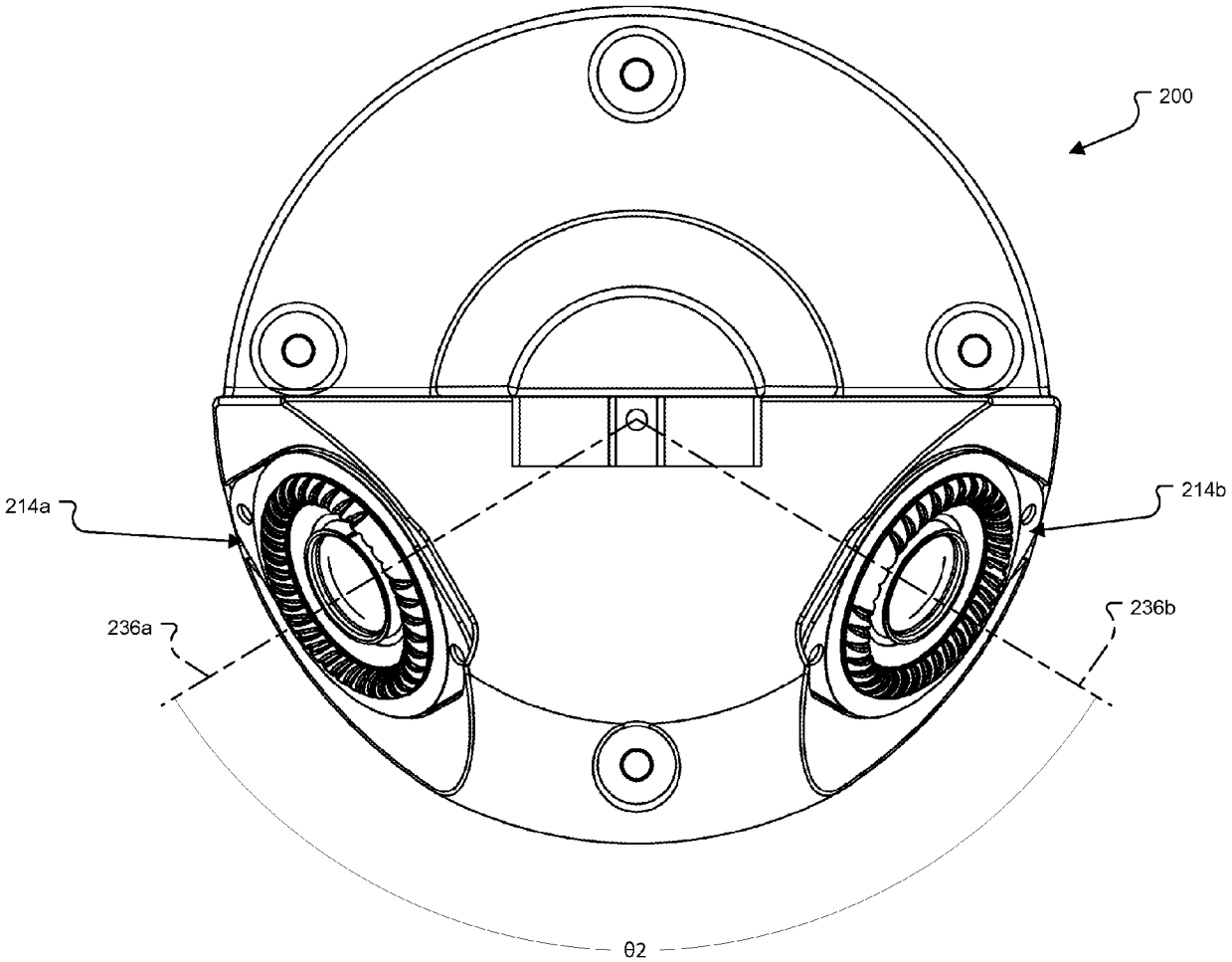
FIG. 4 is a top plan view of the acoustic assembly of FIG. 2.

With reference to FIG. 4, the second and third electro-acoustic drivers 214*a*, 214*b* are also arranged so that there is an azimuth angle θ2 of about 30 degrees to about 90 degrees (e.g., 60 degrees) between their respective motion axes 236*a*, 236*b*. This can help to provide a relatively spacious sound field. The second and third electro-acoustic drivers 214*a*, 214*b* are tweeters for reproducing frequencies in the 2,000 Hz to 20,000 Hz range. The pairing of the tweeters with the full-range driver provides for a bi-amplified system which can help to reduce (e.g., eliminate) intermodulation.

The second acoustic sub-assembly 204 is mounted to the first acoustic sub-assembly 202 so as to form a slot 240 (FIGS. 2 and 3) through which acoustic energy radiated from the front surface of the first electro-acoustic driver 208 can be radiated. The slot 240 is sized to inhibit air flow from flipping around and resonances from occurring within the slot. The cross-sectional area of the slot 240 is equal to or greater than the area of the diaphragm 220 so as not to create a restriction between the driver and free space. This arrangement provides a phase plug configuration which reduces (e.g., eliminates) empty space in front of the diaphragm 220 to discourage resonances and create a stiffer volume to act against so as to move air outside of the slot 240.

Figure 5:
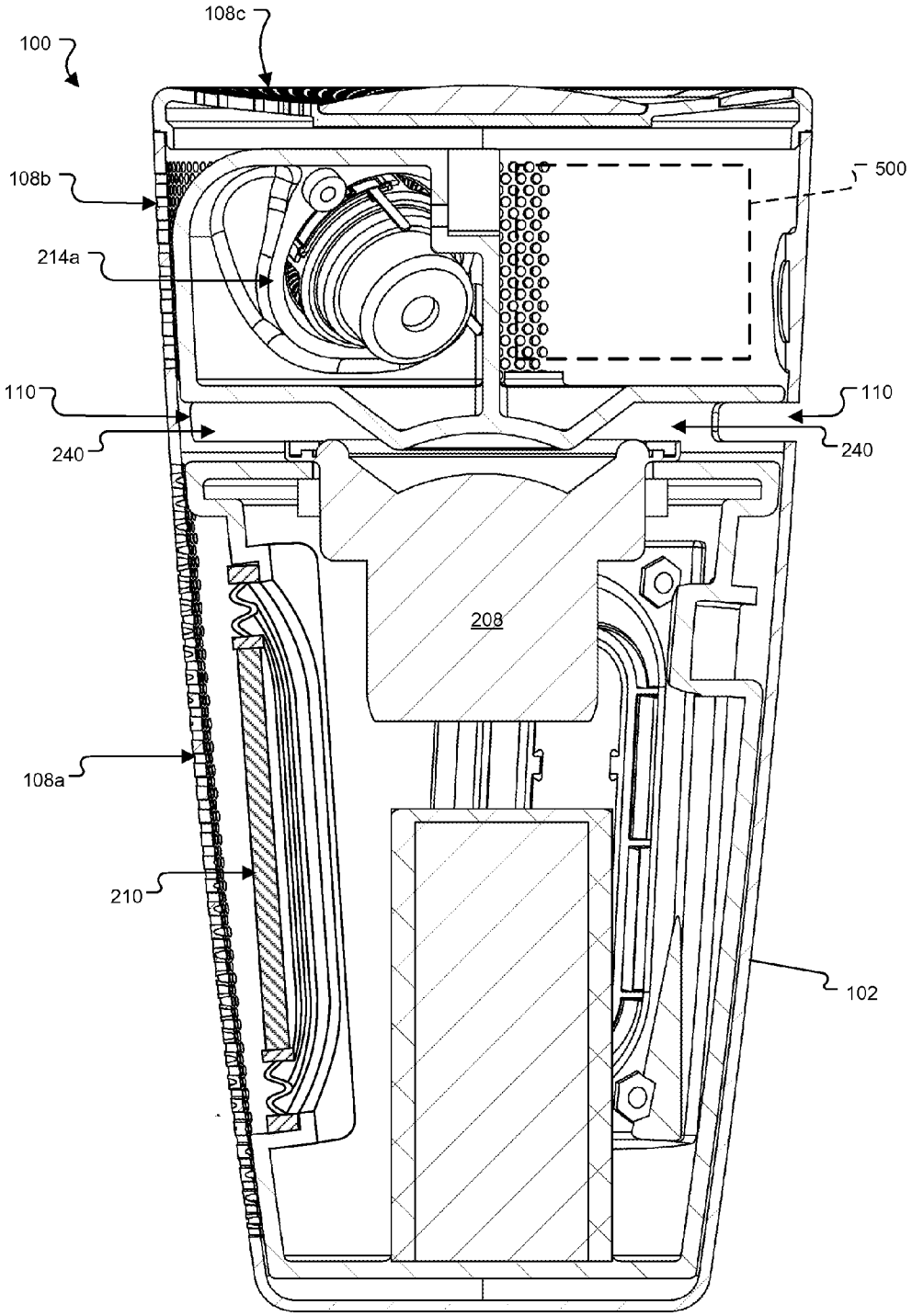
FIG. 5 is a cross-sectional view taken along line 5-5 in FIG. 1B.

Referring to FIG. 5, the slot 240 aligns with the slot openings 110 in the housing 102 to allow acoustic energy radiated from the front surface of first electro-acoustic driver 208 to be radiated out of the slot 240 into a listening area that surrounds the loudspeaker 100.

The passive radiators 210 align with first grille regions 108*a* in the housing 102 to allow acoustic energy radiated from front surfaces of the passive radiators 210 to be radiated into the listening area. Similarly, the second and third electro-acoustic drivers 214*a*, 214*b* (only 214*a* shown in FIG. 5) align with a second grille region 108*b* in the housing 102 and with a third grille region 108*c* in the cover 104 to allow acoustic energy radiated from the front surfaces of the second and third electro-acoustic drivers 214*a*, 214*b* to be radiated into the listening area. An electronics region 500 is provided for accommodation of electronics (e.g., a controller and associated electronics for controlling operation of the drivers).

Figure 6A:
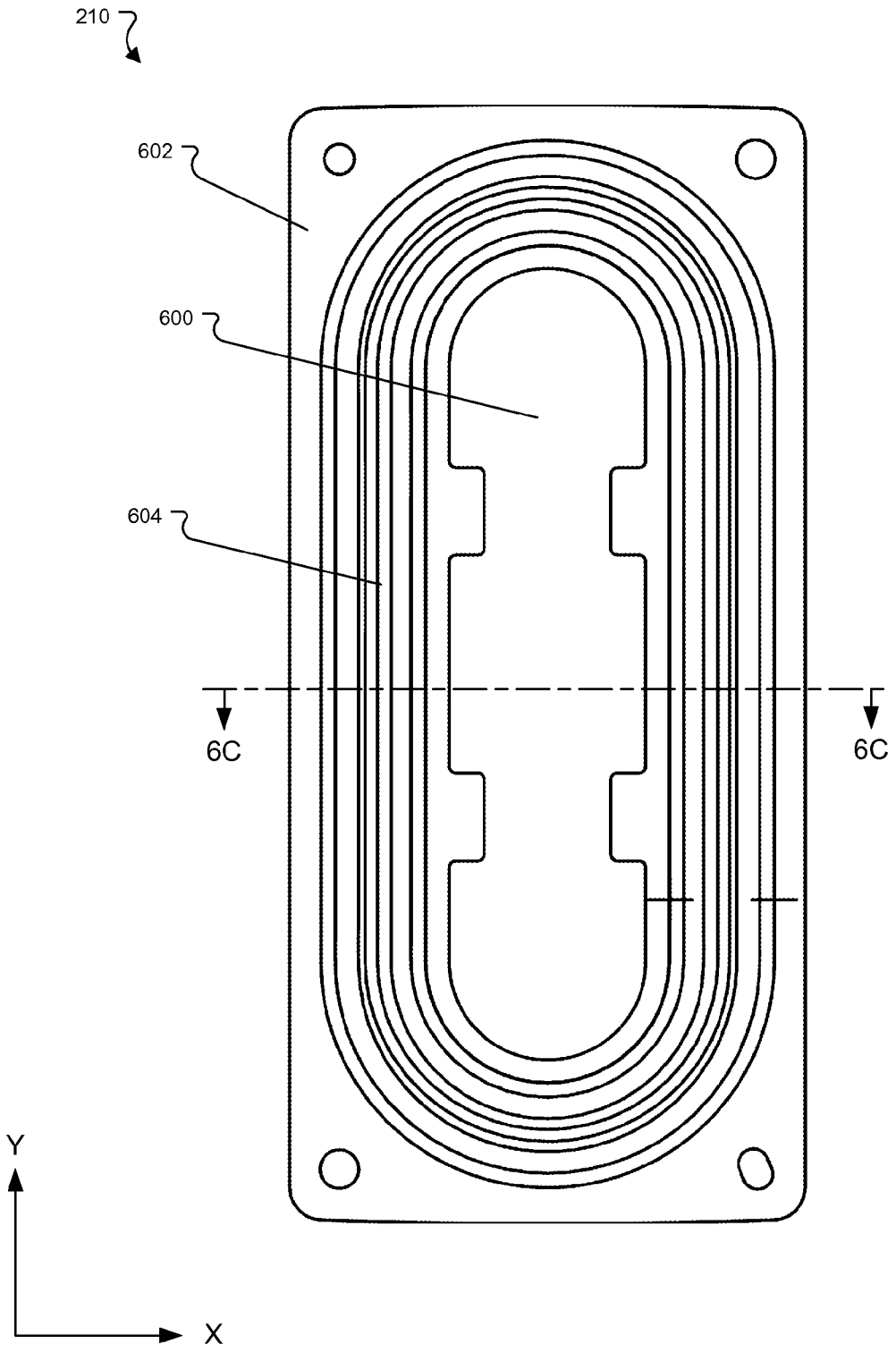
FIG. 6A is a front elevation view of a passive radiator from the portable loudspeaker of FIG. 1.
Figure 6C:
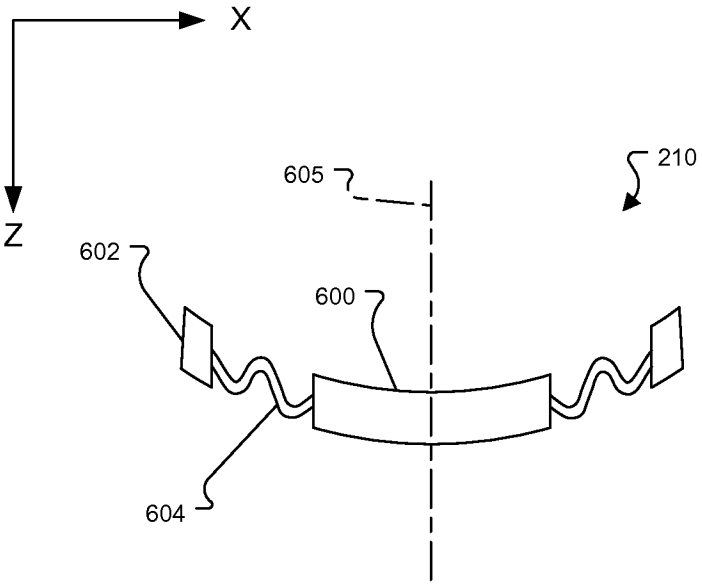
FIG. 6C is a cross-sectional view taken along line 6C-6C in FIG. 6A.
Figure 6B:
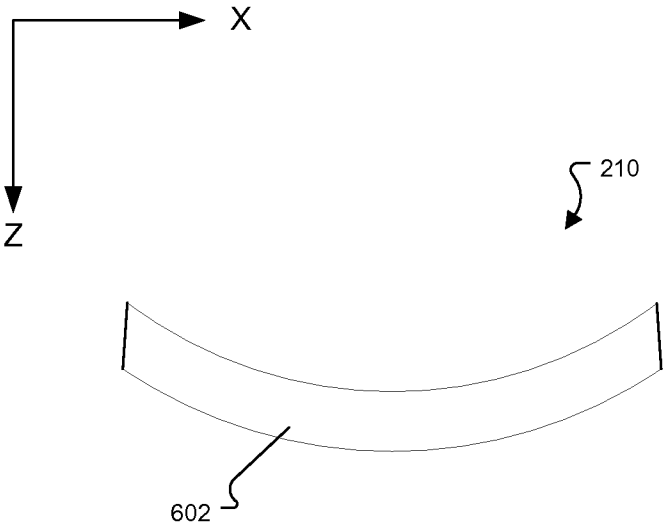
FIG. 6B is a top plan view of the passive radiator of FIG. 6A.

Referring to FIGS. 6A, 6B, and 6C, the passive radiators 110 each include a piston 600 (a/k/a diaphragm), a frame 602, and a suspension (surround) 604 that connects the piston 600 to the frame 602. The frame 602 is secured to the first acoustic enclosure 206 via screws (not shown). The surround 604 may be a shear surround, a half-roll surround, or an alternating half-roll surround which has alternating concave and convex sections.

The piston 600 is driven in linear oscillatory movement, relative to the frame 602 and the first acoustic enclosure 206, along a motion axis 605 (FIG. 6C) via acoustic energy from the first electro-acoustic driver 208. In the XY plane (a first principle plane), the passive radiators 210 have a substantially rectangular shape. Notably, in the ZX plane (a second principle plane), the passive radiators 210 have a curvature which conforms to the curvature of the curved inner surface of the housing 102. As illustrated in FIG. 6B, the passive radiator 210 has the shape of an arc (i.e., an arcuate curvature). In the illustrated example, the frame 602 and the piston 600 of each passive radiator 110 have a curvature which conforms to the curvature of the curved inner surface of the housing 102. The curvature of the frame 602 also allows the frame to be secured against the curved outer surface of the first acoustic enclosure 206.

Figure 7:
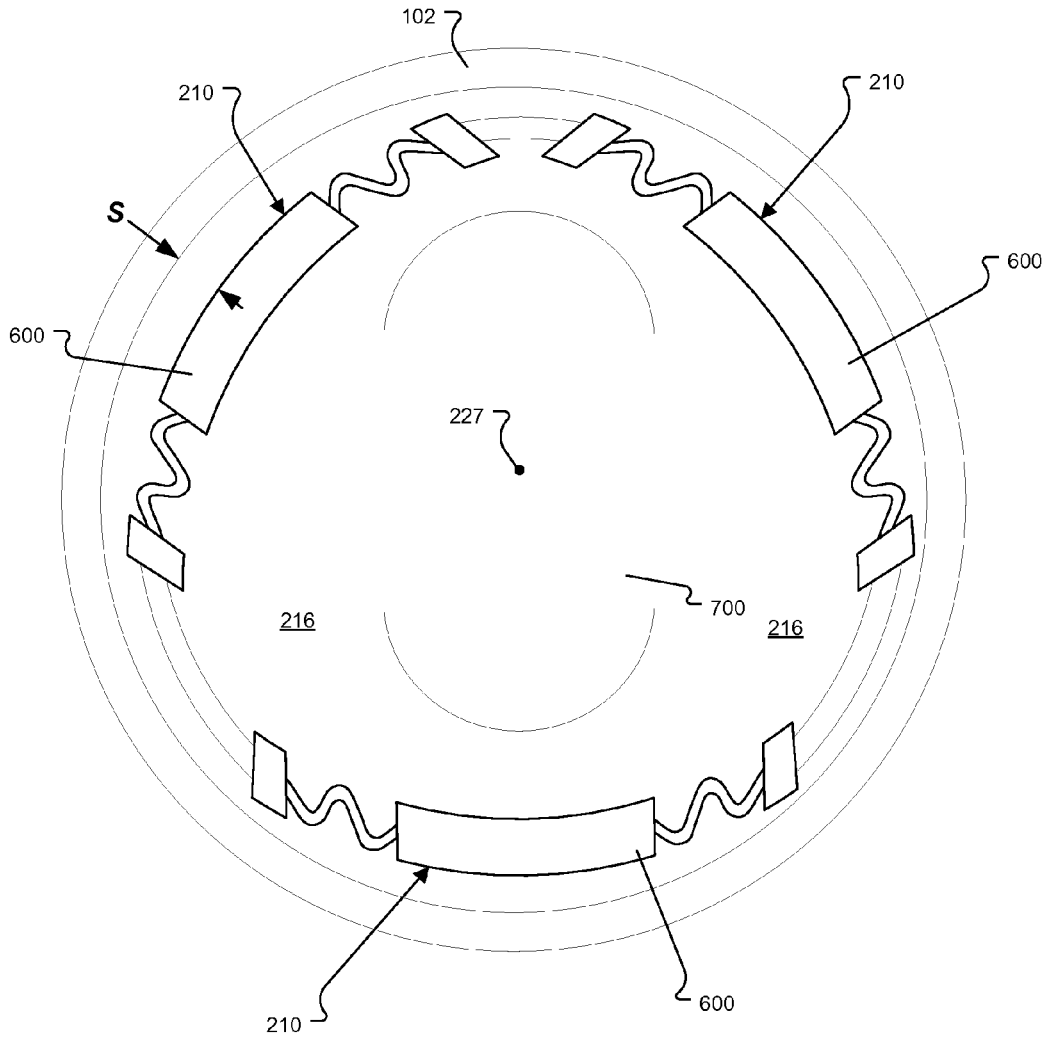
FIG. 7 is a cross-sectional view taken along line 7-7 in FIG. 1B.

The use of such curved passive radiators 210 can allow for a better utilization of space within the housing 102. As shown in FIG. 7, the passive radiators 210 are arranged in a radial array about the vertical axis 227 (a/k/a vertical centerline a/k/a central axis) of the portable loudspeaker 100. The equal spacing of the passive radiators in the array can help to balance the acoustic forces produced by movement of the pistons 600.

Each of the passive radiators 210 faces a respective segment of the curved inner surface of the housing 102, and each of the passive radiators 210 has a curvature which conforms to the curvature of the respective segment of the curved inner surface of the housing 102. This results in a substantially constant spacing S between the passive radiators 210 and the curved inner surface of the housing 102 with the pistons 600 in their rest position. In this example, the radius of curvature of the passive radiator 110 is equal to the radius of curvature of the inner surface of the housing 102 less the spacing S between the passive radiator 110 and the housing 102. In this configuration, the passive radiators 210 only need to be spaced so far away from the inner surface of the housing 102 as is necessary to accommodate the movement of the pistons 600 and any tolerances. This leaves very little unutilized space between the passive radiators 210 and the inner surface of the housing 102.

The curvature of the passive radiators 210 also provides space within the first acoustic volume 216 for accommodation of one or more additional components (e.g., electronic components). In the illustrated example, the space within the acoustic volume 216 is utilized for accommodation of a battery 700. Likewise, the use of curved passive radiators 210 also reduces (e.g., minimizes) the amount of unused space between the passive radiators 210 and the inner surface of the housing 102.

Figure 8:
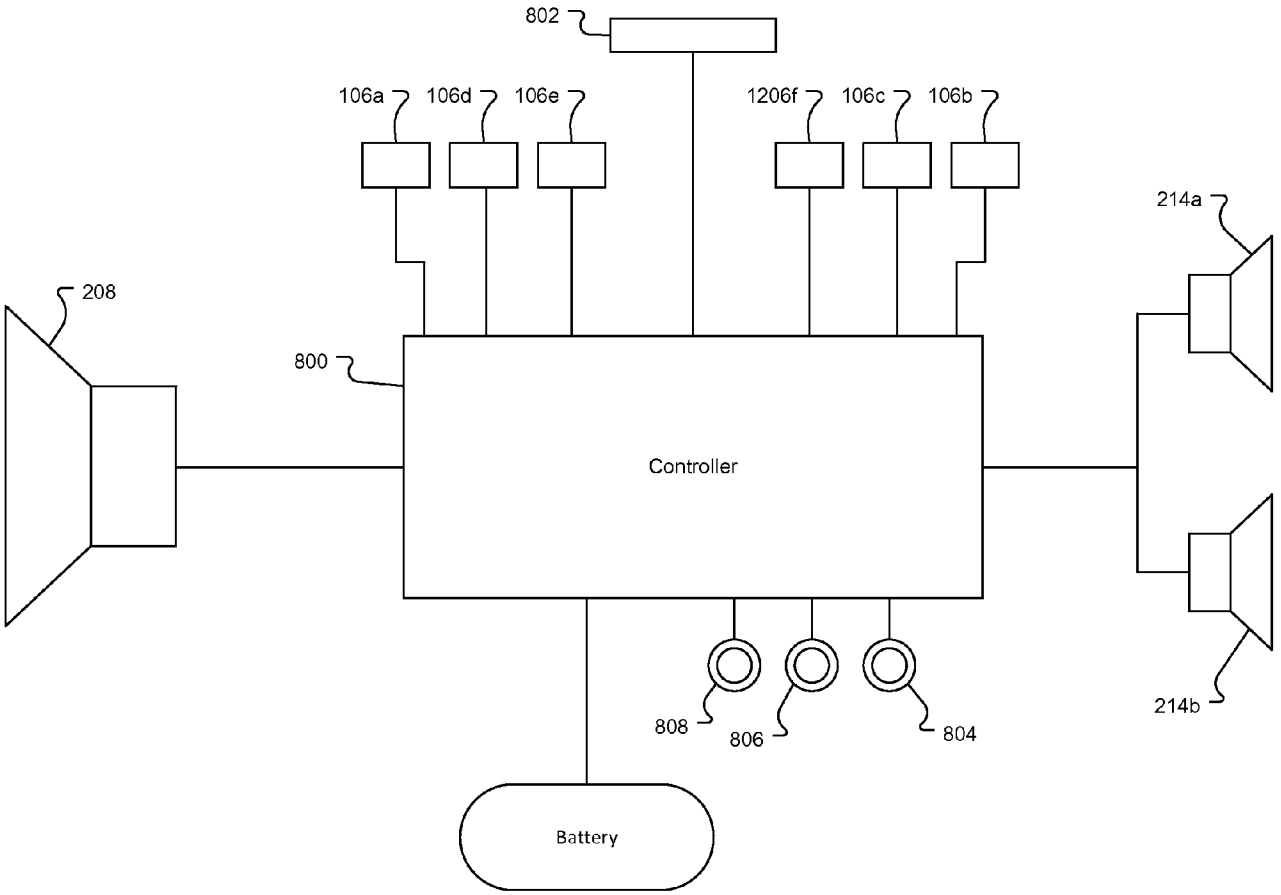
FIG. 8 is a block diagram of the operational portions of the portable loudspeaker of FIG. 1A.

With reference to FIG. 8, the portable loudspeaker 100 includes a controller 800 for controlling operation of the loudspeaker 100. The buttons 106*a-f* provide input to the controller 800 for the specific function that each controls. The battery 700 provides electrical power to the controller 800. Wireless audio signals can be received by a Bluetooth® transceiver and passed to the controller 800 in a digital form. The controller 800 can also communicate back to a Bluetooth® audio source via the transceiver 802. An "Aux In" jack 804 can provide analog audio signals to the controller 800 from a different audio source that is temporarily hardwired to the jack 804. The controller 800 digitizes these signals via an analog-to-digital (A/D) converter.

The controller 800 receives as input signals from an audio signal source, processes the signals, and provides as output streams of audio signals that have spectral content appropriate for the full-range and high frequency drivers. Included in the streams of audio signals are streams of audio signals in a high frequency range (e.g., a 2,000 Hz to 20,000 Hz range) which are provided to the high frequency drivers 214*a*, 214*b*, and streams of audio signals in the low-to-mid frequency range (e.g., 300 Hz to 5000 Hz range) which are provided to the full-range electro acoustic driver 208.

A service port 806 may be utilized for providing software updates to the controller 800. A charging jack 808 may be provided for electrically charging the battery via the controller 800.

Other Implementations

While an implementation has been described in which arcuate passive radiators conform to the curvature of a substantially cylindrical housing, other configurations are possible. For example, in some cases, the housing may have a complex curvature, such as a vase shape, and the passive radiators may also have a complex curvature that conforms to the curvature of the housing.

Although an implementation including a radial array of three passive radiators has been illustrated, the radial array may include fewer or more passive radiators. In one example, the radial array includes a pair of diametrically opposed passive radiators.

An example has been described in which the housing has a cup shape in which an outer surface of the housing conforms to the inner surface of the housing. However, in some cases, the outer surface of the housing may not conform to the inner surface of the housing. Consequently, while the passive radiators have a curvature which conforms to the curvature of the curved inner surface of the housing, the shape of the passive radiators may not conform to that of the outer surface of the housing. For example, the housing may be a molded part with a substantially flat outer surface and a curved inner surface. In such instances, providing passive radiators which conform to the curvature of the inner surface still provides the benefit of reducing unused volume between the passive radiators and the inner surface of the housing, even though the shape of the passive radiators does not conform to that of the outer surface of the housing.

A number of implementations have been described. Nevertheless, it will be understood that additional modifications may be made without departing from the scope of the inventive concepts described herein, and, accordingly, other embodiments are within the scope of the following claims.

What is claimed is:

1. An acoustic device comprising:

an acoustic assembly defining a first acoustic volume, the acoustic assembly comprising:

at least one passive radiator in acoustic communication with the first acoustic volume, the at least one passive radiator comprising a piston; and a first electro-acoustic driver configured to acoustically energize the first acoustic volume so as to drive the piston in oscillatory motion; and a housing within which the acoustic assembly is disposed, the housing having a curved inner surface, wherein a front surface of the passive radiator faces the curved inner surface of the housing, and wherein the passive radiator has a curvature which conforms to the curvature of the curved inner surface of the housing so as to reduce unused space between the front surface of the passive radiator and the curved inner surface of the housing.

2. The acoustic device of claim 1, wherein the at least one passive radiator comprises:

a frame surrounding the piston; and a suspension connecting the piston to the frame such that the piston is displaceable, relative to the frame, along a motion axis, wherein the frame has the curvature which conforms to the curvature of the curved inner surface of the housing.

3. The acoustic device of claim 2, wherein the piston has the curvature which conforms to the curvature of the curved inner surface of the housing.

4. The acoustic device of claim 1, wherein the at least one passive radiator comprises:

a frame surrounding the piston; and a suspension connecting the piston to the frame, wherein the piston has the curvature which conforms to the curvature of the curved inner surface of the housing.

5. The acoustic device of claim 1, wherein the at least one passive radiator comprises a plurality of passive radiators arranged in a radial array about a central axis of the acoustic device.

6. The acoustic device of claim 5, wherein the curved inner surface of the housing circumferentially surrounds the central axis of the acoustic device.

7. The acoustic device of claim 6, wherein each of the passive radiators faces a respective segment of the curved inner surface of the housing, and wherein each of the passive radiators has a curvature which conforms to the curvature of the respective segment of the curved inner surface of the housing.

8. The acoustic device of claim 5, wherein the first electro-acoustic driver is configured to acoustically energize the first acoustic volume so as to drive the plurality of passive radiators in oscillatory motion along respective motion axes.

9. The acoustic device of claim 5, further comprising one or more electronic components disposed within the first acoustic volume in a region between the plurality of passive radiators.

10. The acoustic device of claim 9, wherein the one or more electronic components comprise a battery.

11. The acoustic device of claim 1, wherein a motion axis of the first electro-acoustic driver is coincident with a central axis of the acoustic device.

12. The acoustic device of claim 1, further comprising a cover for enclosing the acoustic assembly within the housing, the cover comprising buttons for controlling operation of the acoustic device.

13. The acoustic device of claim 1, wherein the curved surface of the housing is frustoconical.

14. The acoustic device of claim 1, wherein the housing is cup-shaped.

15. The acoustic device of claim 1, further comprising:

I.) a first acoustic sub-assembly defining a first acoustic chamber and comprising:

a.) The first electro-acoustic driver, and b.) The at least one passive radiator; and II.) a second sub-assembly defining a second acoustic volume and a third acoustic volume, and comprising:

a.) a second electro-acoustic driver; and b.) a third electro-acoustic driver, wherein a portion of the second electro-acoustic driver is located in the second acoustic volume and a portion of the third electro-acoustic driver is located in the third acoustic enclosure.

16. The acoustic device of claim 15, wherein the second and third electro-acoustic drivers are arranged with their respective motion axes at an elevation angle of about 15 degrees to about 45 degrees from horizontal so as to direct acoustic energy in an upward direction during normal operation.

17. The acoustic device of claim 15, wherein the second and third electro-acoustic drivers are arranged with an azimuth angle of about 30 degrees to about 60 degrees between their respective motion axes.

18. The acoustic device of claim 15, wherein the second sub-assembly is mounted to the first sub-assembly so as to form a slot through which acoustic energy from the first electro-acoustic driver can be radiated.

19. The acoustic device of claim 18, wherein the housing has an opening aligned with the slot to allow acoustic energy from the first electro-acoustic driver to be radiated to a listening area acoustically isolated from the first acoustic volume.

20. The acoustic device of claim 1, wherein the acoustic device is a portable loudspeaker.

21. The acoustic device of claim 20, wherein the portable loudspeaker is configured to communicate wirelessly with a source of audio content.

22. The acoustic device of claim 1, wherein the acoustic device is configured to fit within a standard automobile cup holder.

23. The acoustic device of claim 1, wherein the housing has a curved outer surface which conforms to the curvature of the curved inner surface of the housing.

* * * * *